US010051946B1

(12) United States Patent
Lyon et al.

(10) Patent No.: US 10,051,946 B1
(45) Date of Patent: Aug. 21, 2018

(54) RESERVOIR SYSTEM AND METHOD OF USE

(75) Inventors: Matthew J. Lyon, Moraga, CA (US); Samuel M. Lopez, San Francisco, CA (US)

(73) Assignee: Hydrapak, Inc., Oakland, CA (US)

( * ) Notice: Subject to any disclaimer, the term of this patent is extended or adjusted under 35 U.S.C. 154(b) by 353 days.

(21) Appl. No.: 13/353,638

(22) Filed: Jan. 19, 2012

Related U.S. Application Data

(60) Provisional application No. 61/461,559, filed on Jan. 19, 2011.

(51) Int. Cl.
*A45F 3/20* (2006.01)
*A45F 3/16* (2006.01)

(52) U.S. Cl.
CPC ..... *A45F 3/16* (2013.01); *A45F 3/20* (2013.01); *A45F 2003/166* (2013.01)

(58) Field of Classification Search
CPC .... B65D 25/02; B65D 25/102; B65D 35/247; B65D 33/25; B65D 33/2508; B65D 33/2516; B65D 33/2525; B65D 33/2533; B65D 33/2541; B65D 33/255; B65D 33/2558; B65D 33/2566; B65D 33/2575; B65D 33/2583; B65D 33/2591; A45F 2003/166; A61F 2007/0268; A61F 2007/0269; A61F 2007/0273; A45C 7/009; A45C 13/02; A45C 13/03; A45C 2013/026; Y10S 383/901
USPC ..... 224/148.1–148.7; 206/217, 218, 316.1, 206/316.2; 220/529–531, 552, 651, 652, 220/653; 383/901, 61.1, 63, 64, 65, 383/38–40, 97; 138/37, 39, 119, 121; 190/109–111; 222/107
See application file for complete search history.

(56) References Cited

U.S. PATENT DOCUMENTS 1,172,197 A * 2/1916 Cook ..... 383/119
1,506,516 A * 8/1924 Craig ..... 383/38
2,413,686 A 1/1947 Louis
2,916,197 A * 12/1959 Lingenfelter ..... B65D 33/2508 206/219
3,198,392 A * 8/1965 Wilson ..... B65D 35/08 222/107
4,096,978 A * 6/1978 Noice ..... 224/640
4,399,850 A * 8/1983 Schiemann ..... 220/653
4,426,015 A * 1/1984 Preston et al. ..... 229/117.28
4,637,061 A * 1/1987 Riese ..... 383/38
4,878,763 A * 11/1989 Ausnit ..... B65D 33/2508 24/585.12
5,316,387 A * 5/1994 Polett et al. ..... 383/119
5,660,478 A * 8/1997 Alack et al. ..... 383/119
5,941,640 A 8/1999 Thatcher
(Continued)

*Primary Examiner* — Jes F Pascua
*Assistant Examiner* — Nina Attel
(74) *Attorney, Agent, or Firm* — Levine Bagade Han LLP

(57) ABSTRACT

A system for structurally supporting the interior of a fluid reservoir is disclosed. The reservoir can have a reinforcing brace within the reservoir. The brace can be splittable or separable, which can allow the reservoir to be inverted, for example for easier cleaning. The brace can maintain the shape of the reservoir when the reservoir is filled with liquid, preventing the reservoir from forming a cylindrical cross-section. The control of the shape of the reservoir can prevent or minimize distortion of a backpack which is carrying the reservoir.

20 Claims, 15 Drawing Sheets

(56) References Cited

U.S. PATENT DOCUMENTS

| | | | | |
|---|---|---|---|---|
| 6,438,811 | B1 * | 8/2002 | Watanabe | A44B 13/0023 24/662 |
| 8,043,005 | B2 | 10/2011 | Lyon et al. | |
| 2002/0038745 | A1 * | 4/2002 | Lamming | A45C 3/001 190/125 |
| 2003/0147568 | A1 * | 8/2003 | Edwards et al. | 383/119 |
| 2005/0061409 | A1 | 3/2005 | Chung | |
| 2006/0021685 | A1 * | 2/2006 | Cho | 150/113 |
| 2006/0083445 | A1 * | 4/2006 | Billingham | 383/42 |
| 2007/0056998 | A1 * | 3/2007 | Olson | 224/148.2 |
| 2007/0280564 | A1 * | 12/2007 | Lyon et al. | 383/69 |
| 2009/0032348 | A1 * | 2/2009 | Wang | 190/103 |
| 2010/0142862 | A1 * | 6/2010 | Sam | 383/38 |

* cited by examiner

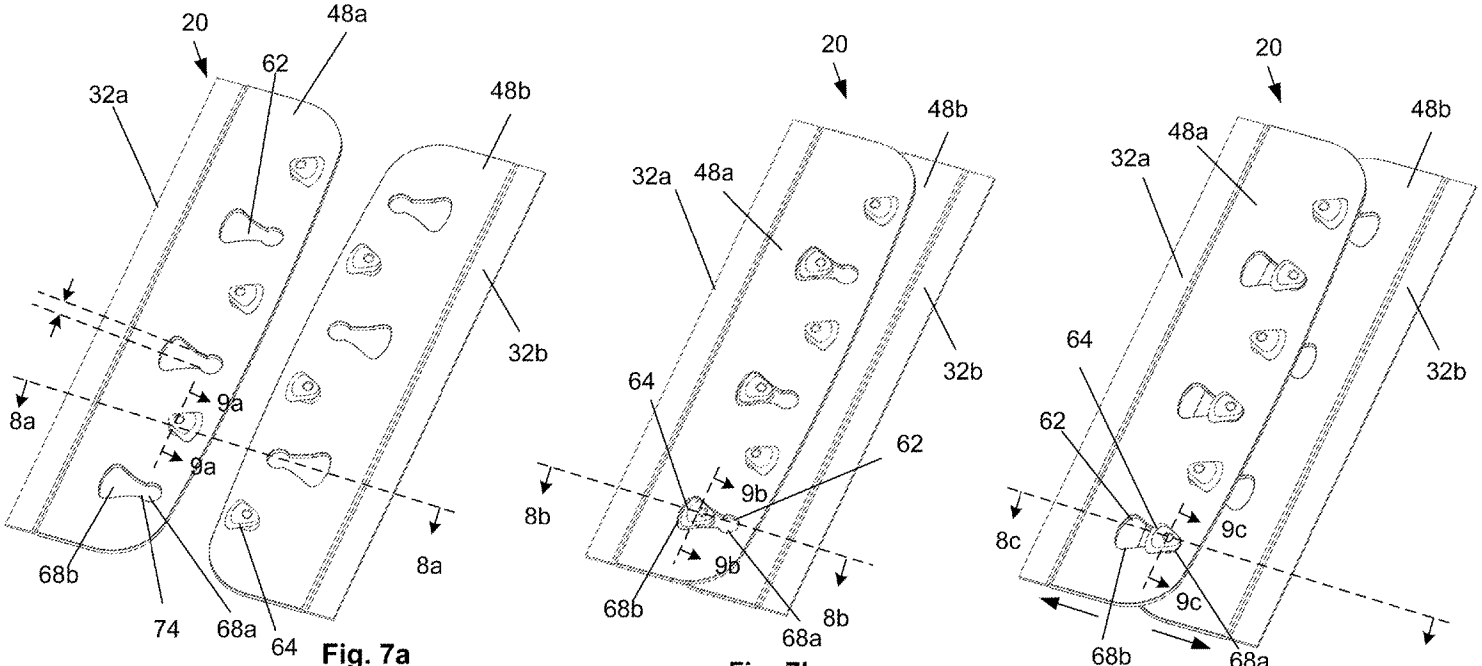
Fig. 7a
Fig. 7b
Fig. 7c
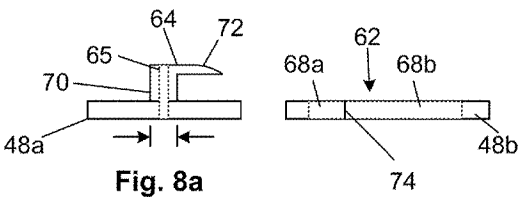
Fig. 8a
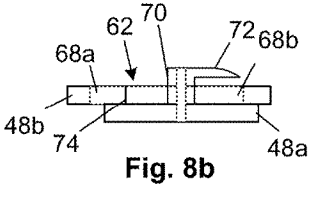
Fig. 8b
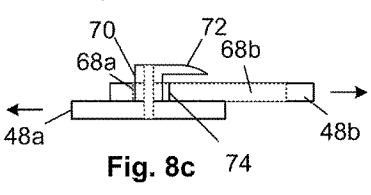
Fig. 8c
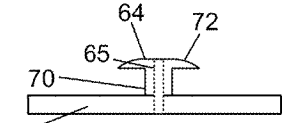
Fig. 9a
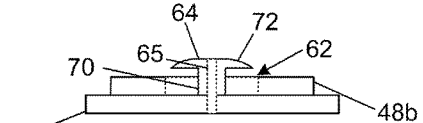
Fig. 9b
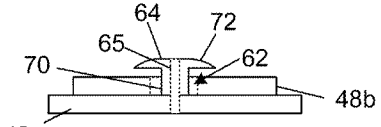
Fig. 9c

RESERVOIR SYSTEM AND METHOD OF USE

CROSS-REFERENCE TO RELATED APPLICATIONS

This application claims priority to U.S. Provisional App. No. 61/461,559, filed 19, Jan. 2011, which is incorporated by reference herein in its entirety.

BACKGROUND OF THE INVENTION

1. Field of the Invention

This invention relates to the field of fluid reservoirs. More specifically, this invention relates to reservoirs that can be stored in a larger bag.

2. Description of the Related Art

Light weight, resealable bags are used increasingly in sporting activities, such as hiking, biking, and snow sport activities like skiing and snowboarding. The reservoirs are often carried in a separate, larger bag, such as in a pocket of a backpack. When storing liquid, the reservoir passively forms a shape based on the placement of the seams and the strength of the walls. Often, the empty reservoir will be generally flat and the liquid-filled reservoir will form a generally cylindrical shape. This change in overall shape results in an awkward fit of the reservoir within the backpack when full, changing the ergonomics of the backpack and pressing into the wearer's back.

Limited access to the interior of typical bags makes cleaning more difficult and increases the potential for unclean and unsanitary bags. Once liquids placed in the bags are consumed, the remaining deposits encourage the growth of bacteria and mold. If left uncleaned, such growths can leave stains on the bag, may retain odors, taint any other fluids subsequently introduced into the bag, and create health risks. Regular and thorough cleaning of the inside of the reservoir is critical.

Commonly used bags for sporting are typically accessible through a relatively small side port in the bag, often covered by a removable cap. The side port limits the access to the interior of the bag, thereby limiting the ability to clean the interior of the bag.

Therefore, a closeable reservoir system is desired that is capable of ease of internal reservoir cleaning and able to hold the reservoir in a generally consistent shape whether empty or full. A closeable reservoir system is also desired that can provide rapid, convenient and clean liquid addition and removal without significantly changing the overall shape of the reservoir. It is also desired to have a closeable reservoir system with a reservoir that can withstand significantly increased fluid pressures without leaking or changing shape so much as to significantly distort the overall shapes of surrounding components. A closeable reservoir system is also desired that is easy and fast to open and close without going through a change in shape.

BRIEF SUMMARY OF THE INVENTION

A reservoir system is disclosed. The system has a container, such as a bag, and a sealing member, and an internal wall, baffle, strut or brace internally connecting opposite sides of the exterior walls. The reservoir system can have a carrier, such as a backpack. The carrier can have one or more pockets. The container can be in one of the carrier pockets.

The container can have a reservoir and an orifice. The orifice can have closed and open configurations. The reservoir can be in fluid communication with the orifice. The orifice can have an orifice closed length when the orifice is in the closed configuration.

The scaling member can be configured to slidably attach to the container. The sealing member can have has a seal length. The seal length can be at least substantially equal to the orifice closed length. The sealing mechanism can be configured to seal the container. The sealing member can have a substantially straight configuration.

The sealing member can be configured to attachably engage the container. The container can have a first end and a first side, and wherein the orifice is at the first end. The container can have an opening on the first side of the container. The reservoir system can have a cap removably attached to the opening. The cap can have a socket configured to attach to a tube. The scaling member can be tethered to the container. The sealing member can be configured to be interference fit to the container.

The brace can be separable into two pieces and/or from one or more sides of the exterior bag wall. The brace can have a re-attachable component. The re-attachable component can be a zipper, locking fork, brace slider, buckles, buttons and slots, straps and slots, lace and holes, hook and loop tape, or combinations thereof. With the sealing member removed and the brace separated, the bag can be inverted, for example, for ease of cleaning and access.

When finished with the need to access the inside of the bag, the bag can be everted (or "inverted" if the original motion described herein as inverting is actually considered by the reader as evening), the brace can be reattached. The reservoir can then be refilled with liquid, which may not cause a significant change in the depth of the bag due to the tension of the brace. The slider can be then be reattached to the bag, sealing the liquid in the reservoir.

BRIEF DESCRIPTION OF THE FIGURES

FIG. 4*b* is a variation of cross-section C-C along a length of the bag with the brace slider shown in see-through.

FIG. 4*c* is a perspective view of a variation of the brace of the bag in FIG. 4*a* with the brace slider shown in see-through.

FIGS. 7*a* through 7*c* illustrate a method of attaching two portions of a variation of a brace.

FIGS. 8*a* through 8*c* are width sectional views 8*a*-8*a*, 8*b*-8*b*, and 8*c*-8*c* of a portion of FIGS. 7*a* through 7*c*, respectively.

FIGS. 9*a* through 9*c* are length sectional views 9*a*-9*a*, 9*b*-9*b*, and 9*c*-9*c* of a portion of FIGS. 7*a* through 7*c*, respectively.

FIG. 10*s* is a variation of cross-section 10*s* of FIG. 10*r*.

DETAILED DESCRIPTION

Figure 1:
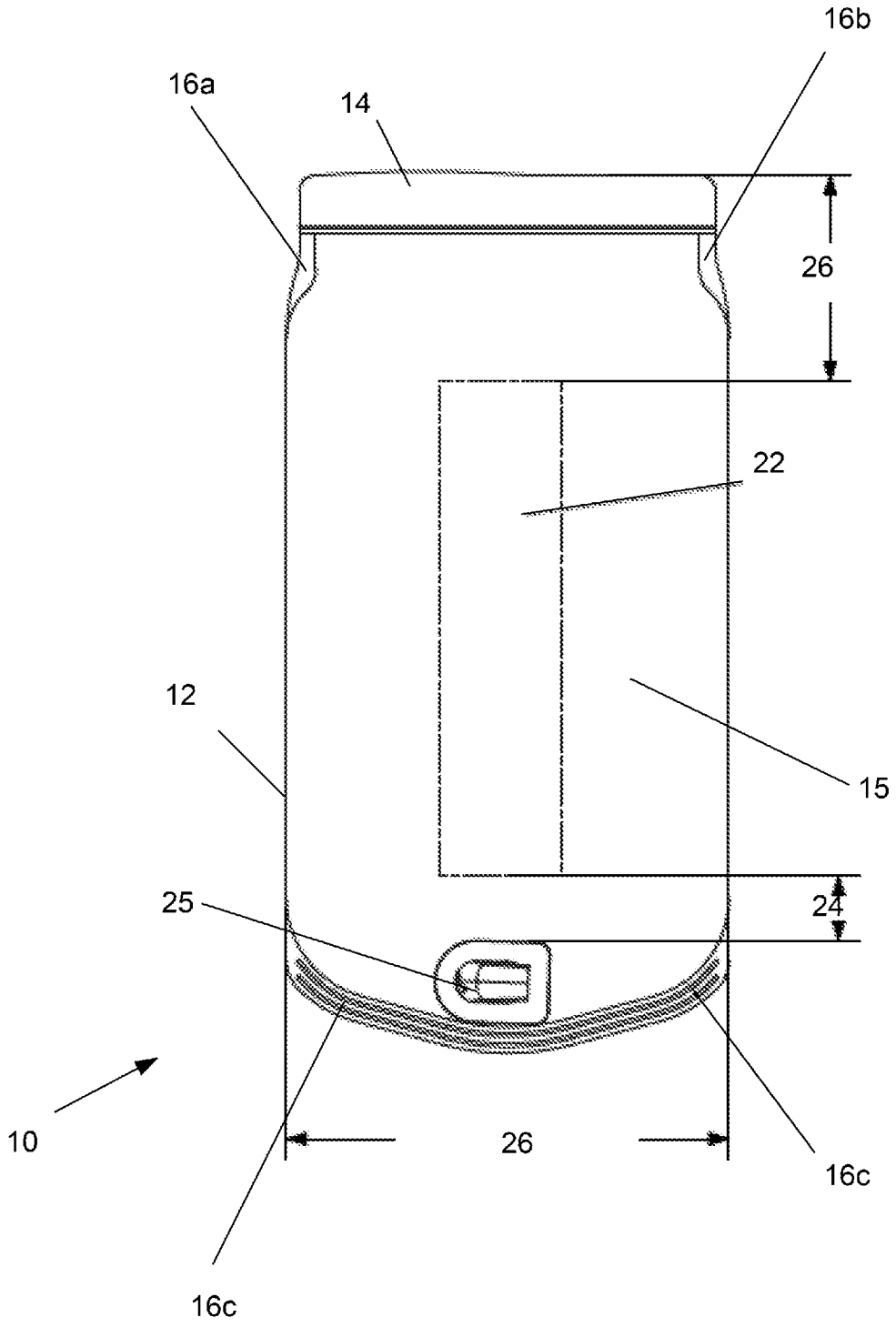
FIG. 1 illustrates a variation of the reservoir system.

FIG. 1 illustrates that a reservoir system 10 can have a reservoir container, such as a bag 12, and a sealing member, such as an elongated slider 14. The bag 12 can have a reservoir 15, such as one or more partially or completely hollow cavities defined by the bag 12. Multiple reservoirs (not shown) can be in the bag 12. For example, the bag cavity can be divided into one or more separate compartments by one or more septa, bladders and/or other liquid dividers.

The bag 12 can have one or more bag reinforcements 16, such as bag seals. The bag reinforcements 16 can strengthen one or more higher-probability mechanical failure areas on the bag 12. For example, first and second bag reinforcements 16*a* and 16*b* can be located on opposite sides of the bag 12 adjacent to the primary bag opening near the slider 14. A third reinforcement 16*c* can be located along all or a portion of the width of the bottom of the bag 12. The bag seals can have thicker dimensions than the surrounding material. The bag seals can have layers of the material of the bag 12 or a different material attached to and/or integral with the bag 12. The bag seals can be along all or part (as shown) of the circumference of the bag 12, for example, excluding the portion of the bag 12 adjacent to the orifice.

The slider 14 and the bag 12 can be configured to facilitate slidably translating the slider 14 on the bag 12. The slider 14 can have a slider seal configured to seal the orifice. The slider seal can be, for example, the location on the slider 14 where the dimensions of slider arms force the bag 12 to seal the bag 12. The top of the bag 12 can have an orifice and a first lip 18*a* and a second lip 18*b* surrounding the orifice. The slider 14 can pressure seal the bag 12 by pressing the first lip 18*a* and the second lip 18*b* together.

The bag 12 can be made from a single sheet or from separate sheets, for example, integrated and/or attached at the bag seams. The lips 18 can have lip seams. The lip seams can be part of the bag seams. The bag and/or lip seams can be leak-proof and water-tight when pressed together, for example by the slider 14.

The bag 12 and slider 14 can have any of the features, elements, or other disclosure from U.S. patent application Ser. No. 11/445,721, filed 2 Jun. 2006, now U.S. Pat. No. 8,043,005, which is incorporated by reference in its entirety.

The bag 12 can have a brace 20 inside of the reservoir 15. The brace 20 can be positioned within a brace zone 22. The brace zone 22 can be spaced from the outflow socket 25 or nozzle by a brace zone bottom gap 24. The brace zone bottom gap 24 can be from about 0 in. to about 3 in., for example about 0.5 in. The brace 20 can be spaced from the top of the bag 12 by a brace zone top gap 26. The brace zone top gap 26 can be from about 0 in. to about 5 in., for example about 2.75 in.

The bag 12 can have a bag width 26, for example any width or widths about 1 in. wider than those described in U.S. patent application Ser. No. 11/445,721, supra.

Figure 2C:
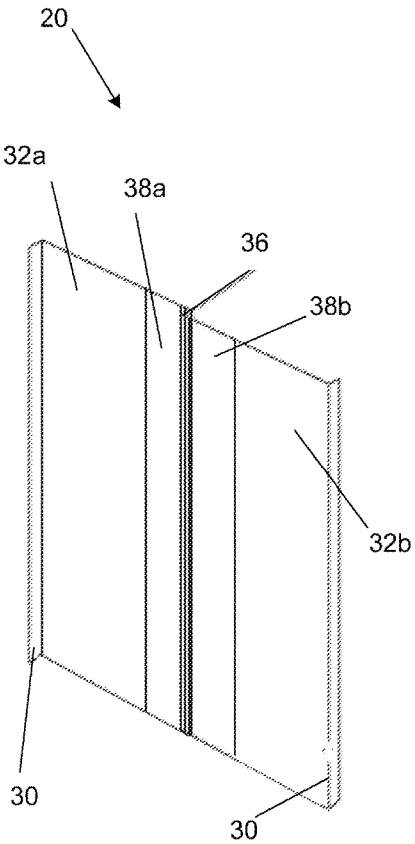
FIG. 2*c* is a perspective view of a variation of the brace of the bag in FIG. 2*a*.
Figure 2B:
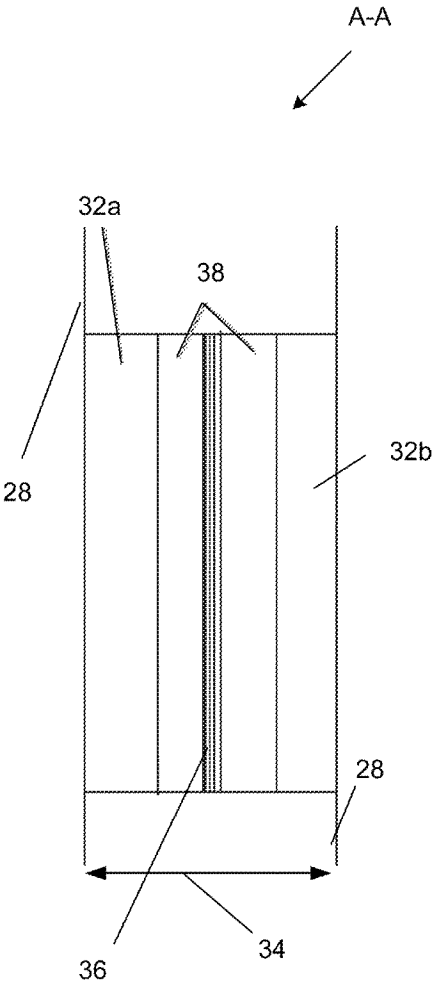
FIG. 2*b* is a variation of cross-section A-A along a length of the bag.
Figure 2A:
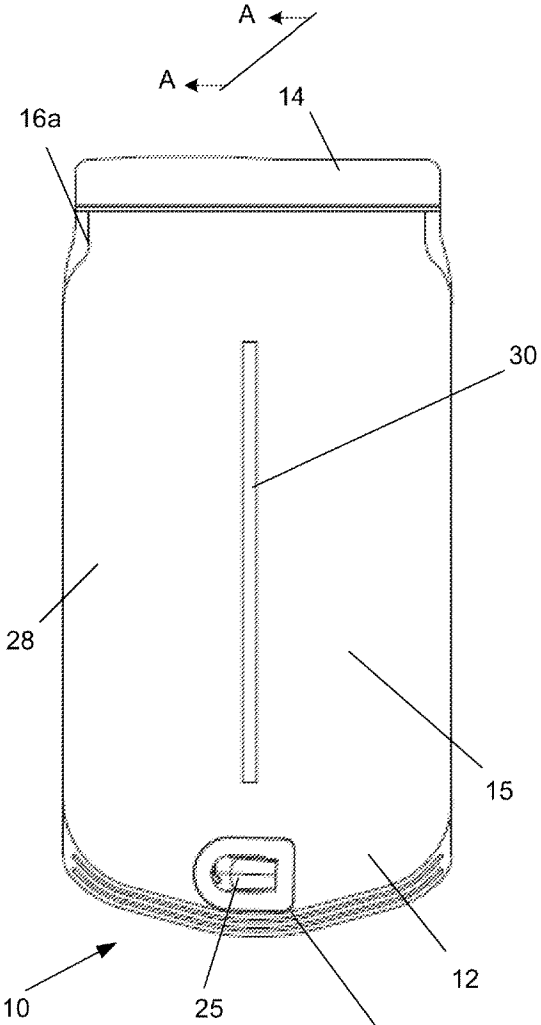
FIG. 2*a* is a front view of a variation of the reservoir system.

FIG. 2*a* illustrates that the bag 12 can have a bag exterior wall 28. The bag exterior wall 28 can be the wall of the bag 12 excluding the brace wall in the reservoir 15.

The bag 12 can have a brace exterior connector 30. The brace exterior connector 30 may or may not be visible from the outside of the bag 12 (e.g., the bag 12 can be opaque, the brace exterior connector 30 can be transparent, or the bag 12 and/or brace exterior connector 30 can be translucent). The brace exterior connector 30 can be releasably attached or fused to the interior or exterior of the bag exterior wall 30. The brace exterior connector 30 can be welded, epoxied or glued, melted, snapped, buttoned, connected by a hook and loop tape, or combinations thereof to the bag exterior wall 28. The brace exterior connector 30 can be an integrated element or feature of the brace 20.

The brace exterior connector 30 can be positioned to be laterally centered with respect to the bag 12 and/or the outlet socket 25 or nozzle.

FIG. 2*b* illustrates that the brace 20 can have a catch or brace first wall 32*a* and/or a catch or brace second wall 32*b*. The brace first wall 32*a* can be attached or integrated with a first side of the bag exterior wall 28. The brace second wall 32*b* can be attached or integrated with a second side of the bag exterior wall 28 opposite the first side of the bag exterior wall where the brace first wall 32*a* is attached or integrated.

The brace first wall 32*a* can be directly or indirectly separably attached to the brace second wall 32*b* and/or the opposite side of the bag exterior wall 28 (e.g., when the bag 12 has no brace second wall 32*b*).

The brace 20 can have a brace depth 34 when the brace 20 is assembled (e.g., when the zipper is zipped). The brace depth 34 can be from about 0.5 in. to about 4 in., for example about 2 in.

The brace 20 can have a zipper 36 or zip fastener. The zipper 36 can be a coil zipper, invisible zipper, metallic zipper, plastic-molded zipper, open-ended zipper, closed-ended zipper, or combinations thereof. The first brace wall 32*a* and second brace wall 32*b* (or opposing exterior bag wall) can be connected to each other when the zipper 36 is lined up and pressed together.

The zipper 36 can be attached to a zipper first wall 38*a* and a zipper second wall 38*b*. The zipper first wall 38*a* can releasably connect with a zipper second wall 38*b*. The catch walls or zipper walls 38 can overlap each other beyond the zipper 36. The zipper first wall 38*a* and/or zipper second wall 38*b* can be part of the brace first wall 32*a* and/or brace second wall 32*b*, respectively, or be a separate element attached to the respective brace walls 32.

The brace 20 can be configured to maintain a fixed depth and/or maximum depth of the middle of the bag 12. For example, the brace walls 32 and zipper walls 38 can be configured to resist bending or distortion. For example, the brace walls 32 and/or zipper walls 38 can have two, three or more layers of wall material, reinforcing structural geometry such as ribs, struts, or combinations thereof.

The brace walls 32 can have a brace wall thickness from about 0.1 mm to about mm, for example about 6.4 mm, about 5 mm, about 2 mm or about 0.25 mm. The brace 20 and the components of the brace 20 can be made from TPU, any of the other materials listed herein or combinations thereof.

FIG. 2*c* illustrates that the brace exterior connectors 30 can extend at right angles from the ends of each of the brace walls 32. The brace exterior connectors 30 can be flanges securing the brace 20 to the bag exterior wall 28.

Figure 3A:
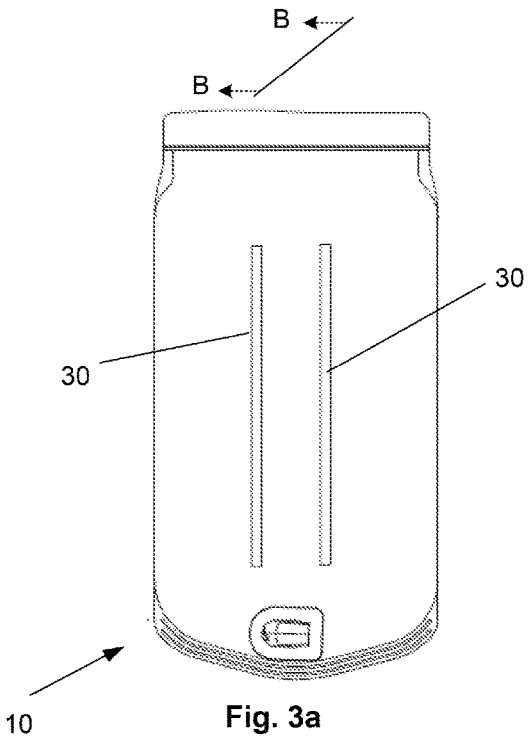
FIG. 3*a* is a front view of a variation of the reservoir system.

FIG. 3*a* illustrates that the bag 12 can have two brace exterior connectors 30 attached to each side (e.g., front and back) of the bag 12. The lateral center of the connection points or lines brace exterior connectors can be aligned laterally with the outlet socket 25 or nozzle.

Figure 3B:
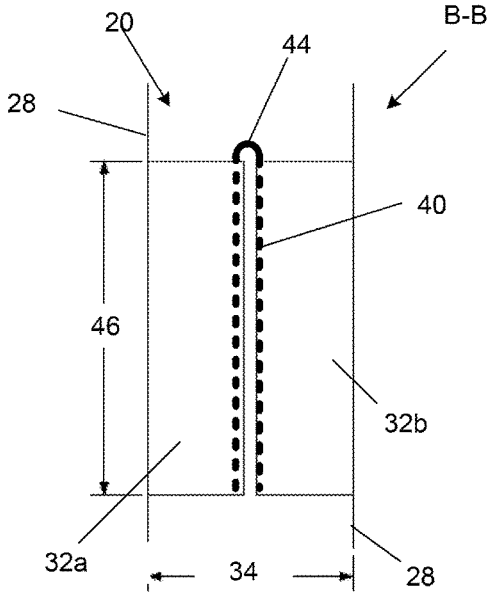
FIG. 3*b* is a variation of cross-section B-B along a length of the bag.

FIG. 3*b* illustrates that the brace 20 can have a removable locking fork 40. The locking fork 40 can be a clamp. The locking fork 40 can fixedly hold the first brace wall 32*a* to the second brace wall 32*b*, for example at a fixed distance spaced apart or compressed together. For example, the brace first wall 32*a* can be held in contact with the second brace wall 32*b* or at a brace wall gap. The brace wall gap can be from 0 mm to about 5 mm, for example about 0 mm. The locking fork 40 can be substantially rigid. The locking fork 40 can have a first arm or prong 42*a* and a second arm or prong 42*b*. The arms 42 can be held together at a fork head 44. The fork head 44 can be integral with or attached to the prongs 42. The fork head 44 can hold the first and second prongs 42 in tension toward each other.

The brace 20 can have a brace height 46. The brace height 46 can be from about 1 in. to about 14 in., more narrowly from about 3 in. to about 9 in., for example about 8.8 in.

Figure 3D:
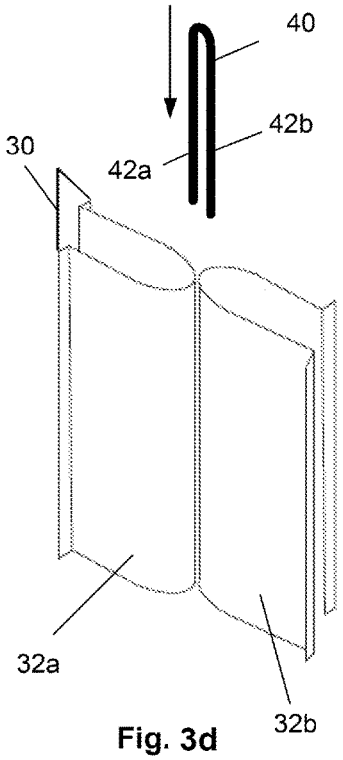
FIGS. 3*c* and 3*d* illustrate a variation of a method for assembling the brace of FIG. 3*b*.
Figure 3C:
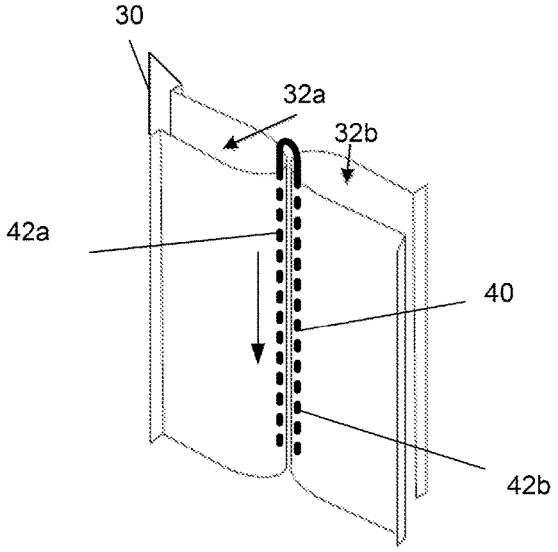

FIG. 3*c* illustrates that the brace first wall 32*a* and brace second wall 32*b* can have U-shaped configurations. The brace first wall 32*a* and brace second wall 32*b* can each form a tube with the bag exterior wall 28.

FIG. 3*d* illustrates that the locking fork 40 can be slid over the brace walls 32 so that the first prong 42*a* of the locking fork 40 can be positioned lateral to the medial-most portion of the brace first wall 32*a*, and the second prong can be positioned lateral to the medial-most portion of the brace second wall 32*b*. The first prong 42*a* can be in the tube formed by the brace first wall 32*a* and the second prong 42*b* can be in the tube formed by the brace second wall 38*b*. The prongs 42 can press medially against the respective brace walls 32.

The locking fork 40 can be translated over the brace walls 32 until the locking fork head interference fits against the brace walls 32. The locking fork 40 can be slidably removed from the brace walls 32, for example releasing the brace walls 32 to allow inverting of the bag 12.

Figure 4C:
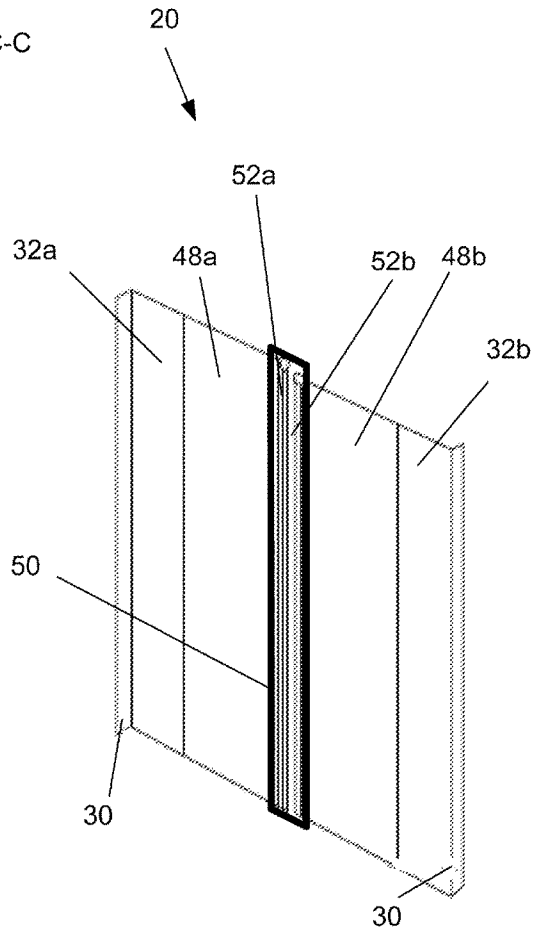
Figure 4B:
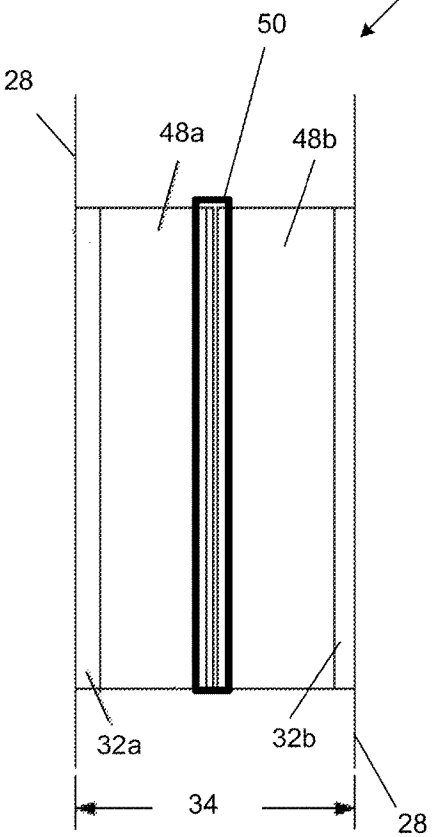
Figure 4A:
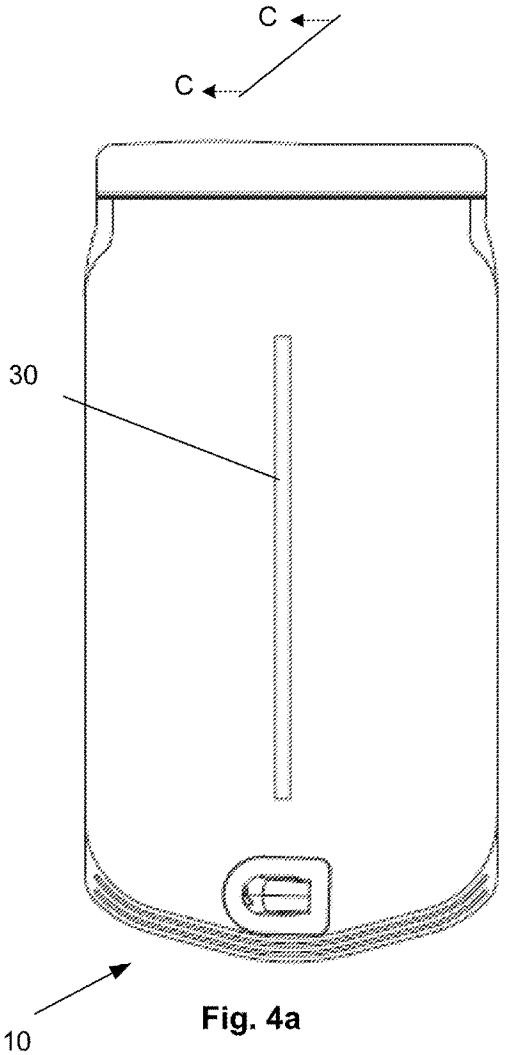
FIG. 4*a* is a front view of a variation of the reservoir system.

FIGS. 4*a* through 4*c* illustrate that the brace 20 can have catch first wall 48*a* opposite a catch second wall 48*b*. The catch walls 48 can be part of (i.e., integrated with) or extend from the brace walls 32.

The catch walls 48 can be configured to slidably engage a brace slider 50. The first catch wall 48*a* can medially terminate at a catch first side 52*a*. The second catch wall 48*b* can terminate at a catch second side 52*b*. The catch sides 52 can have guides and/or configurations similar to how the lips 18 of the bag 12 are configured to receive the slider 14.

The brace slider 50 can be slid along and over the catch first side 52*a* and catch second side 52*b* similar to the translation of the locking fork 40, supra. The brace slider can attach to the catch first side 52*a* and the catch second side 52*b*. The brace slider 50 can fix the catch first wall 52*a* to the catch second wall 52*b*. The brace slider 50 can hold the catch first side 52*a* sealed against or at a fixed distance from the catch second side 52*b*. The brace slider 50 can be slidably removed from the catch sides 52, for example, to release the first catch wall 52*a* from the second catch wall 52*b* allowing inverting of the bag 12.

Figures 5A, 5B, 5C:
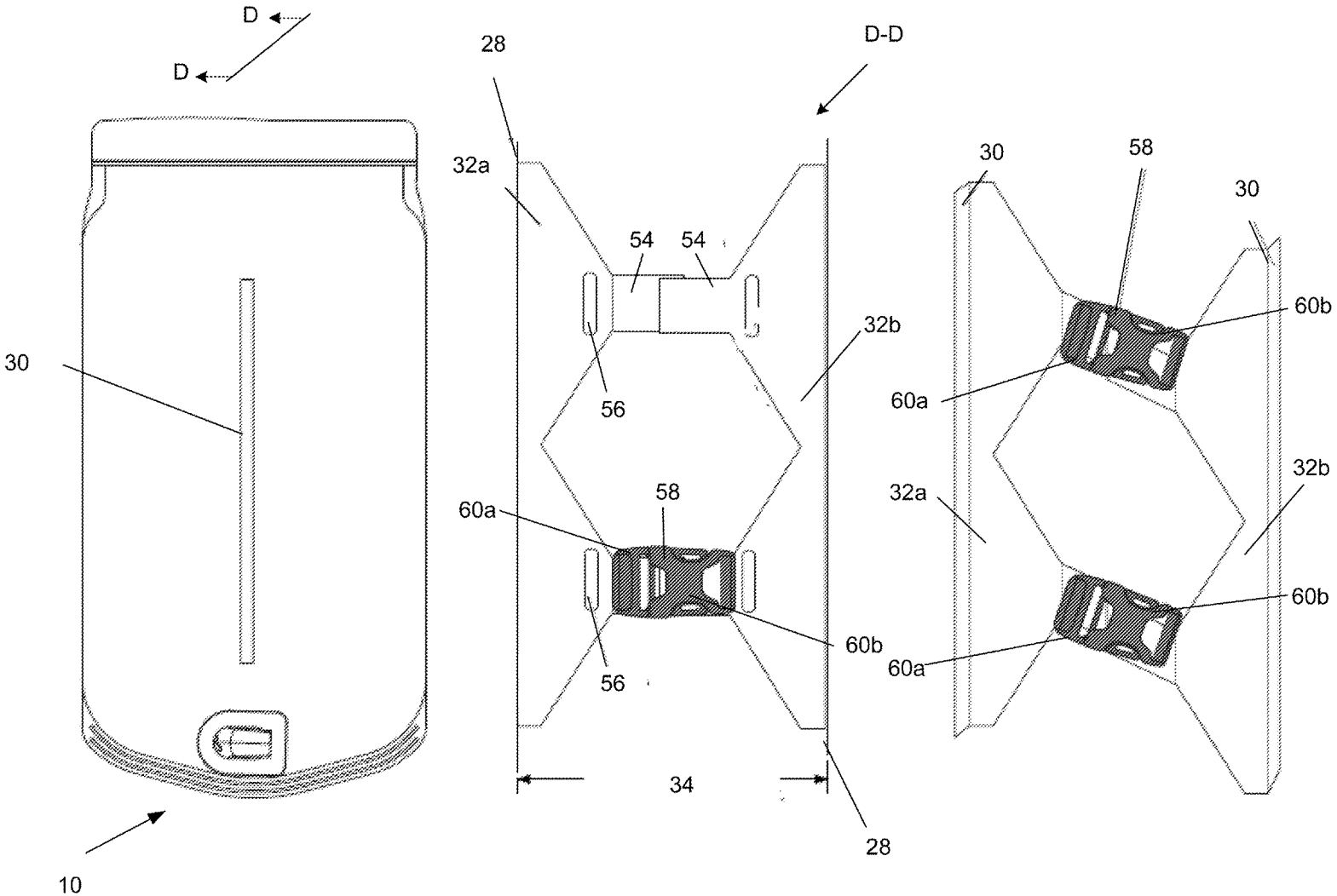
FIG. 5*a* is a front view of a variation of the reservoir system.
FIG. 5*b* is a variation of cross-section D-D along a length of the bag (with a buckle removed for illustrative purposes).
FIG. 5*c* is a perspective view of a variation of the brace of the bag in FIG. 5*a*.

FIGS. 5*a* through 5*c* illustrates that the brace 50 can have one or more buckle straps 54 extending from one or both brace walls 32. The buckle straps 54 can be integral with the brace walls 32 or attached to the brace walls 32 with strap attachments 56, such as a weld, epoxy or glue, melting, snap, button, hook and loop tape, or combinations thereof. The buckle straps 54 can be positioned along the height of the bag 12 to align with a buckle strap 54 from the opposite brace wall 32.

One or more buckles 58 can be attached to the buckle straps 54. The buckles 58 can be side release buckles. The buckle straps 54 can be wrapped around, threaded through or otherwise fed through the buckles 58 to attach to the buckles 58. The buckle straps 54 can be welded, epoxied or glued, melted, snapped, buttoned, attached by hook and loop tape, or combinations thereof to the buckles 58. The buckle straps 54 can be wrapped around, threaded through or otherwise fed through the buckles 58 and then the buckle straps 54 can be secured to themselves, for example by welding, epoxying or gluing, melting, snapping, buttoning, attaching by hook and loop tape, or combinations thereof.

The buckles 58 can have two, separable portions or parts, for example, a buckle male portion 60*a* and a buckle female portion 60*b*. The buckle male portion 60*a* can be slidably attachable and detachable from the buckle female portion 60*b*. The buckle portions 60 can snap together and be squeezed to be released and separated. The buckles can releasably hold the brace first wall 32*a* to the brace second wall 32*b*.

Figure 6C:
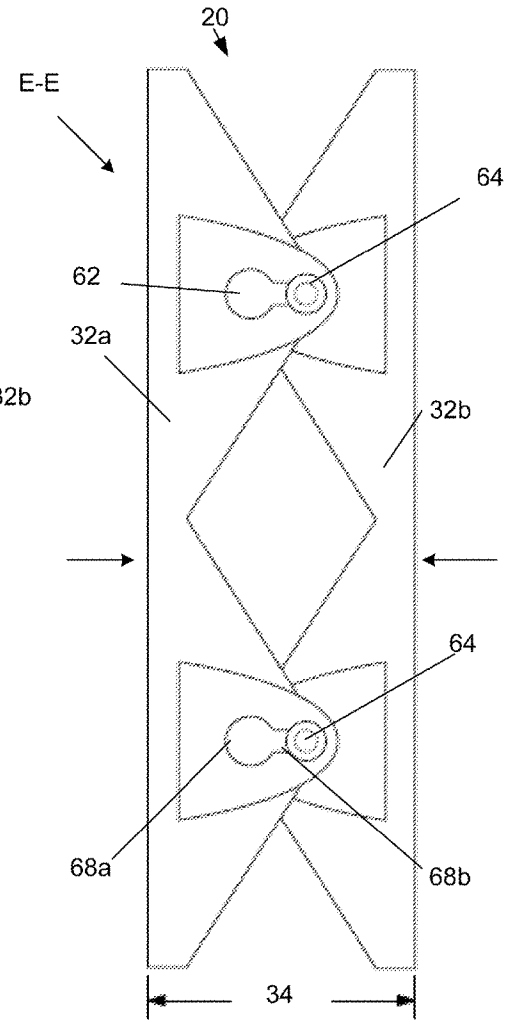
FIG. 6*c* is a variation of cross-section E-E along a length of the bag with the brace in an assembled configuration.
Figure 6B:
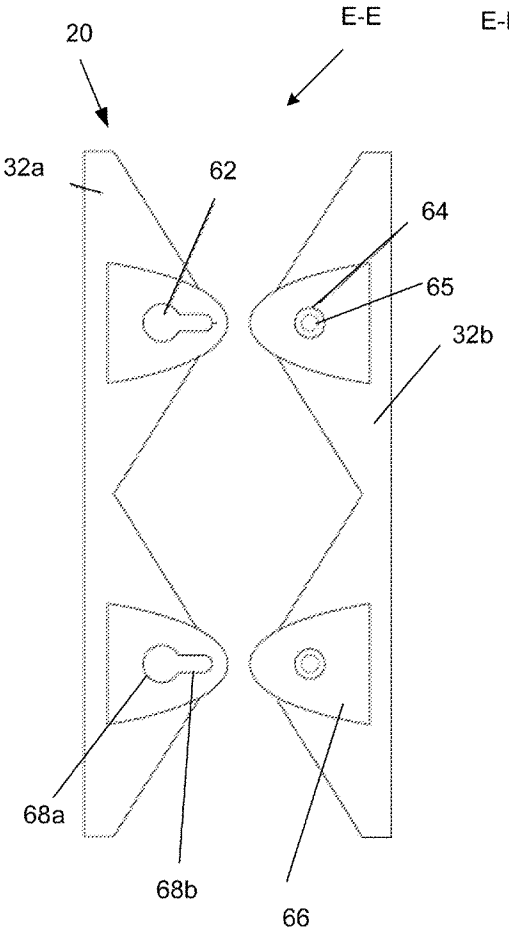
FIG. 6*b* is a variation of cross-section E-E along a length of the bag with the brace in an unassembled configuration.
Figure 6A:
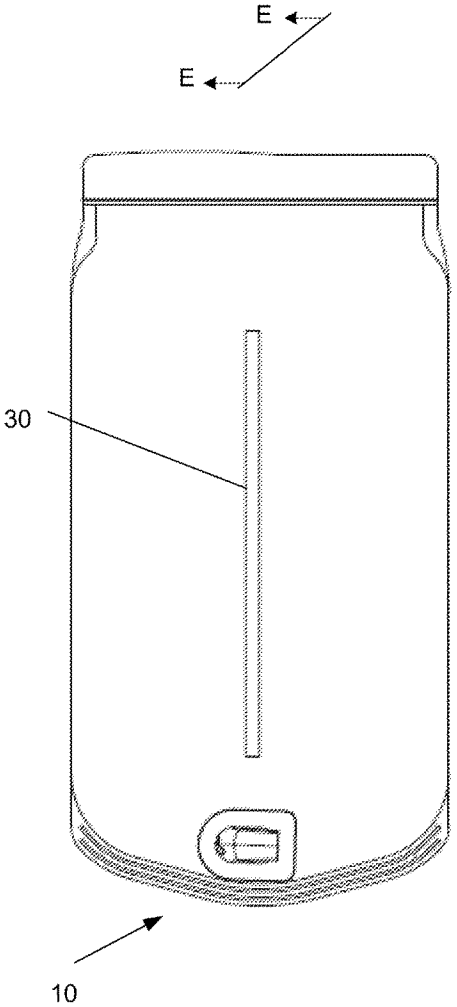
FIG. 6*a* is a front view of a variation of the reservoir system.

FIGS. 6*a* and 6*b* illustrates that the brace first wall 32*a* can have one or more slots 62 and/or buttons 64. The brace second wall 32*b* can have one or more buttons 64 and/or slots 62. The slots 62 and/or buttons 64 can be formed in or on or attached to the brace walls 32 or on wall mounts 66 that are attached to the brace walls 32. The slots 62 can be molded from or cut into the brace wall 32 and/or wall mount 66 material. The buttons 64 can be a bollard standard molded button. The buttons 64 can be attached to the brace walls 32 and/or wall mounts 66 with a button rivet 65, adhesive, hook and loop tape, or a combinations thereof.

The slots 62 can have a slot wide length 68*a* and a slot narrow length 68*b*. The buttons 64 can be placed into the slot wide lengths 68*a* of the corresponding slots 62. The slots 62 and buttons 64 can be configured so the button 64 can pass in and out of, and slide along, the slot wide length 68*a*. The slots 62 and buttons 64 can be configured so the button 64 can not pass in and out of (i.e., out of plane with the brace walls 32), but can still slide along, the slot narrow length 68*b*. For example, the buttons 64 can have button heads and button stems. The button heads can extend from the button stems. The button beads can be wider than the width of the slot narrow lengths 68*b* and narrower than the slot wide lengths 68*a*. The buttons 64 and slots 62 can be positioned along the height of the bag 12 to align with the opposite configuration (i.e., if a button 64, then aligned with a slot 62, and vice versa) on the opposite brace wall. The button 64 and slot 62 can be configured so the button 64 can slide along the entire length of the slot 62. The button 64 and slot 62 can be configured so the button snaps or otherwise locks into the terminal end of the slot narrow length 68*b*.

FIG. 6*c* illustrates that the brace first wall 32*a* and second brace wall 32*b* can be brought toward each other, as shown by arrows. The buttons 64 can be attached to the slots 62, for example, holding the brace first wall 32*a* and the brace second wall 32*b* together or at a fixed distance.

FIGS. 7*a*, 8*a* and 9*a* illustrate that each button 64 can have a button stem 70. The button stem 70 can extend from the brace wall 32 and/or catch wall at an angle from about 45° to about −45° from the perpendicular. For example, the button stem 70 can extend perpendicular from the brace wall 32 and/or catch wall 48. The button rivet 65 can attach the button 64 to the brace wall 32 and/or catch wall 48. For example the button rivet 65 can through the axial centerline of the button stem 70. The button stem 70 can have a button stem width or diameter 71. The button stem diameter 71 can be from about 1 mm to about 10 mm, for example about 4 mm.

The button 64 can have a button head 72 extending laterally from the button stem 70. For example, the button head 72 can extend perpendicular to the button stem 70 at the terminal end of the button stem 70. The button head 72 can have a rounded triangular configuration when viewed perpendicular to the plane of the brace wall 32 and/or catch wall 48. The button head 72 can be spaced from the surface of the brace wall 32 and/or catch wall 48 by the button stem 70, for example at a length about equal to or greater than the thickness of the opposing brace wall 32 and/or catch wall 48.

The slot 62 can have a slot snap 74. The slot snap 74 can be a narrowing in the slot 62 between the slot wide length 68*a* and the slot narrow length 68*b*. The slot snap 74 can have a slot snap width 75. The slot snap width 75 can be from about 1 mm to about 7 mm, for example about 2.9 mm. The slot snap width 75 can be the same width or a slightly narrower width than the button stem diameter 71. For example, the slot snap width 75 can be equal to or greater than about 99% of the button stem diameter 71, more narrowly about equal to or greater than about 95%, yet more narrowly about equal to or greater than about 80%, yet more narrowly about equal to or greater than about 72.5%, yet more narrowly about equal to or greater than about 65%.

FIGS. 7*b*, 8*b* and 9*b* illustrate that the brace first wall 32*a* and/or catch first wall 48*a* can be pulled toward and to overlap the brace second wall 32*b* and/or catch second wall 48*b*. The buttons 64 of the brace second wall 32*b* and/or catch second wall 48*b* can be inserted into the slot wide lengths 68*b* of the brace first wall 32*a* and/or catch first wall 48*a*. The button heads 72 can be narrower than the slot wide lengths 68*b*, for example the button heads 72 can be passed through the slot wide lengths 68*b*. The brace second wall 32*b* and/or catch second wall 48*b* can be between the button head 72 and the brace first wall 32*a* and/or catch first wall 48*a*.

FIGS. 7*c*, 8*c* and 9*c* illustrate that the brace first wall 32*a* and/or catch first wall 48*a* and the brace second wall 32*b* and/or catch second wall 48*b* can be pulled away from each other, as shown by arrows (i.e., or one of the walls 32*a* and/or 48*a* can be held still while the other 32*b* and/or 48*b* is pulled away). The button stem 70 can be initially in the slot wide length 68*a*. When the brace first wall 32*a* and/or catch first wall 48*a* is be pulled away from the brace second wall 32*b* and/or catch second wall 48*b*, the button stem 70 can pass the slot snap 74 and be positioned in the slot narrow length 68*b*. When the button stem 70 passes the slot snap 74, the slot snap can elastically deform, for example as the slot snap 74 is forced wider by the passing button stem 70. The slot snap 74 can resist the button stem 70 from exiting the slot narrow length 68*b*.

The button head 72 can prevent the brace first wall 32*a* and/or catch first wall 48*a* from being separated from the brace second wall 32*b* and/or catch second wall 48*b* out of plane of the brace walls 32 or catch walls 48. For example, as shown in FIG. 9*c*, the button head 72 can be wider than the slot narrow length 68*b*. Accordingly, the button head 72 can interference fit against the brace second wall 32*b* and/or the catch second head 48*b*.

The bag, brace, sliders, straps, buckles, buttons and any and all other elements described herein can be made from polyethylene, such as high density polyethylene (HDPE) or low density polyethylene (LDPE) (e.g., linear LDPE), polytetrafluoroethylene (PTFE), polyurethane (e.g., thermoplastic polyurethane (TPU)), polyvinyl chloride (PVC), thermoplastic elastomer (TPE), polyoxymethylene (POM), also known as acetal resin, polytrioxane and polyformaldehyde (e.g., Delrin by E.I. du Pont de Nemours and Company, Wilmington, Del.), Nylon, or combinations thereof. For example, the slider can be made from POM and the bag can be made from TPU.

Method of Making

The bag can be molded and/or any and/or all of the elements of the bag, including the brace, can be welded (e.g., RF welded) together. The slider can be molded and/or any and/or all of the elements of the slider can be welded (e.g., RF welded) together Methods of Use FIG. 10*a* illustrates a front view of the reservoir system 10 that can have a brace 20 with a zipper configuration, similar to the configuration shown in FIGS. 2*a* through 2*c*. The slider 14 can be tethered to the bag 12 by a leash attached to the slider 14 and the bag 12, or the slider 14 can be untethered to the bag 12.

Figure 10B:
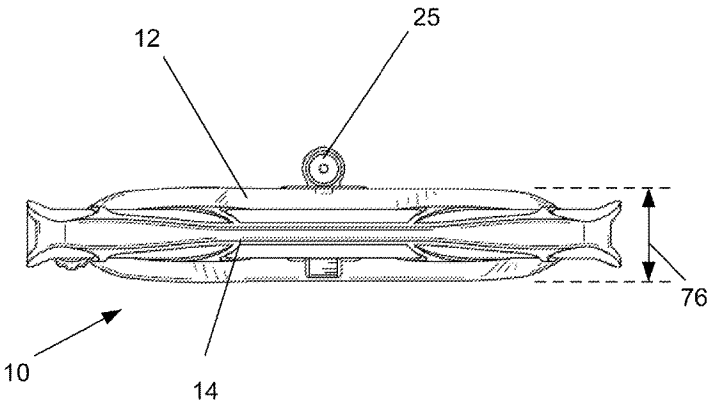
FIGS. 10*a* through 10*s* illustrate a variation of a method for using a variation of the reservoir system.
FIG. 10*m* is a variation of cross-section 10*m* of FIG. 10*l*.
FIG. 10*o* is a variation of cross-section 10*o* of FIG. 10*n*.
FIG. 10*q* is a variation of cross-section 10*q* of FIG. 10*p*.

FIG. 10*b* illustrates a top view showing that the bag 12 can have a bag depth 76. The bag depth 76 can be substantially or absolutely constant whether the reservoir 15 is full or empty of liquid. For example, the bag depth 76 can be substantially equal to the brace depth 34, with the additional thickness of the bag exterior wall 28. Accordingly, the bag 12 can maintain a substantially similar shape whether the reservoir 15 is full or empty of liquid, for example when the brace is in place and assembled (e.g., when the brace first wall 32*a* is attached, fixed or secured to the brace second wall 32*b*).

Figure 10D:
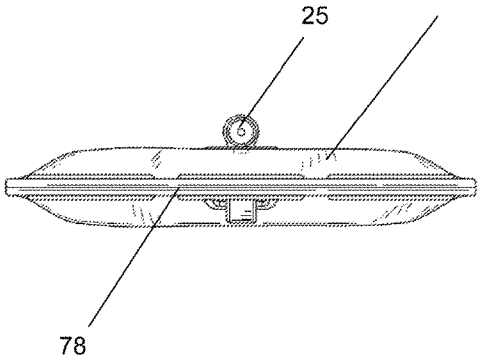
Figure 10A:
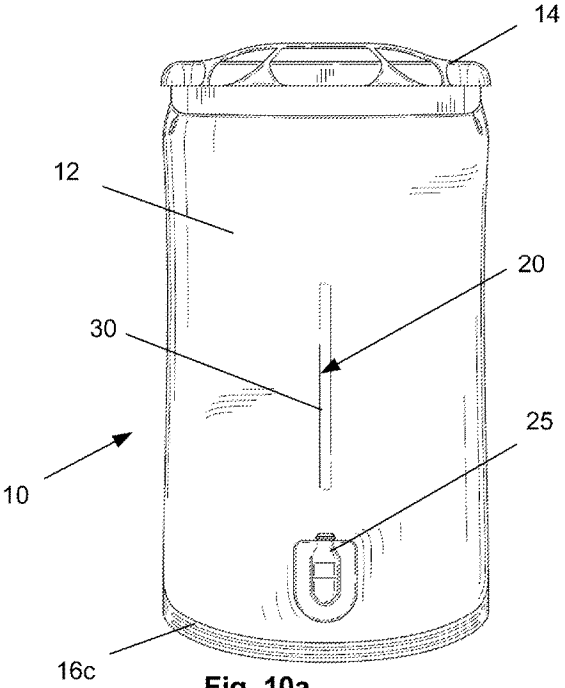
Figure 10C:
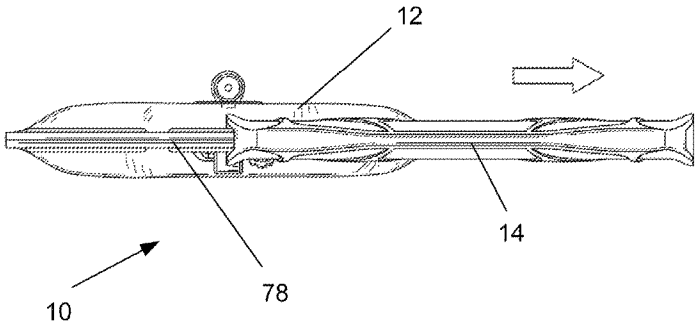

FIG. 10*c* illustrates that the slider 14 can be translatably removed, as shown by arrow, from the bag 12. The removal of the slider 14 from the bag 12 can expose the closed filling orifice 78 of the reservoir 15. FIG. 10*d* illustrates that the slider 14 can be completely removed from the bag 12, allowing the lips 18 surrounding the orifice 78 to be manipulated, such as by being opened or closed.

Figure 10F:
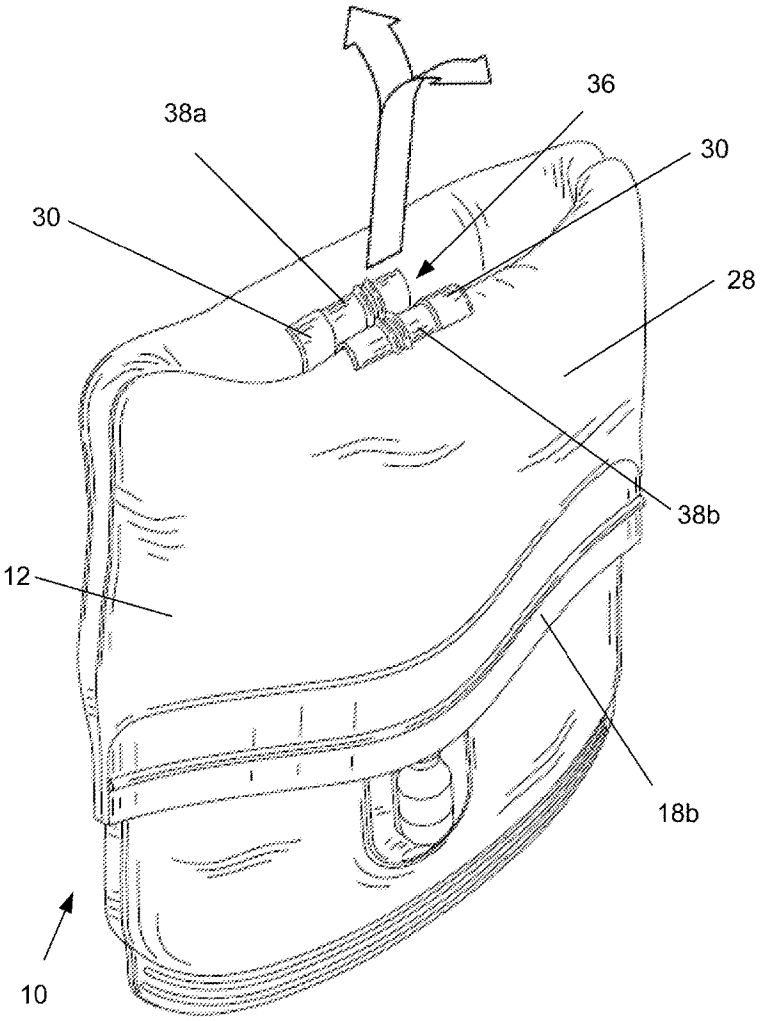
Figure 10E:
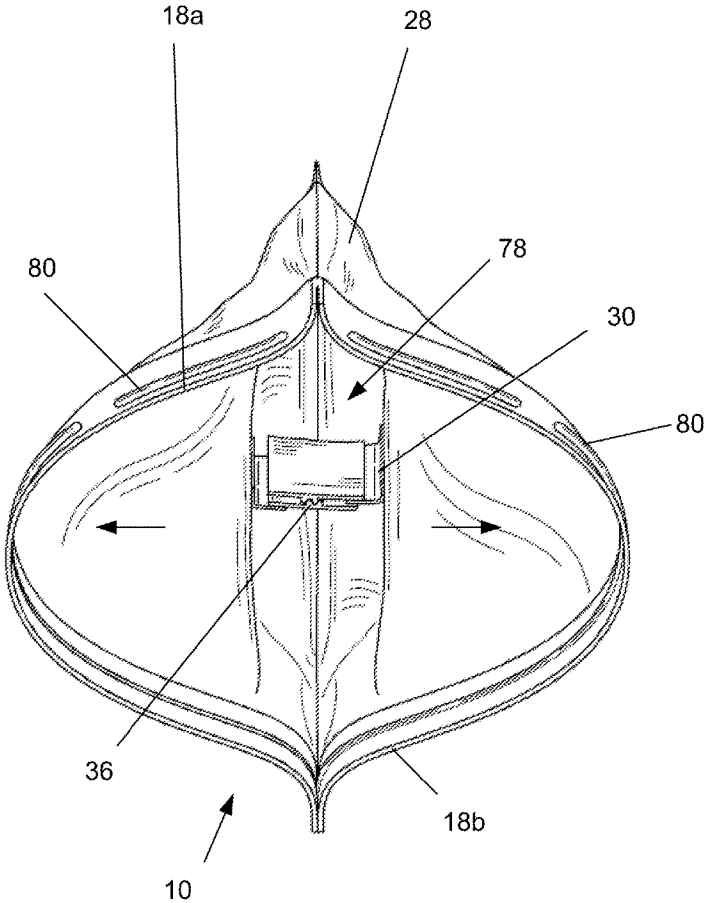

FIG. 10*e* illustrates that the bag can have the first lip 18*a* and second lip 18*b*, for example, adjacent to the orifice 78. The first lip 18*a* can be opposite the second lip 18*b*. The lips 18 can be reinforced. The lips 18 can be thicker and/or otherwise more reinforced and/or stronger than the surrounding material of the bag 12. The bag 12 can have one or more guides 80, for example on the lips 18. The guide 80 can extend perpendicular to the bag exterior wall 28 and/or lips 18. The guide 80 direct the slider 14 during use as the slider 14 is slid over and off the lips 18. The first lip 18*a* can have one or more first engagement members, such as first guides 80. The guides 80 can be a part or all of the engagement members. The second lip 18*b* can have one or more second engagement members, such as second guides 80. The slider 14 can slidably engage the guides 80. The slider 14 can attach to the lips 18 at the guides 80.

The first lip 12*a* and second lip 12*b* can be pulled apart, as shown by arrows. When the orifice 78 is open, the brace 20 and zipper 36 can be accessed and manipulated as described herein.

FIG. 10*f* illustrates that the bag 12 can be partially inverted. (The use of "inverted" herein is describing turning the bag inside out by pulling the lips of the bag outward around the remainder of the bag. This manipulation may also be considered "everted.") The zipper 36 can be pulled apart, as shown by arrows. The zipper 36 can be pulled apart by inverting the bag 12 and/or by manually pulling the zipper first wall 38*a* away from the zipper second wall 38*b*, as shown.

Figure 10H:
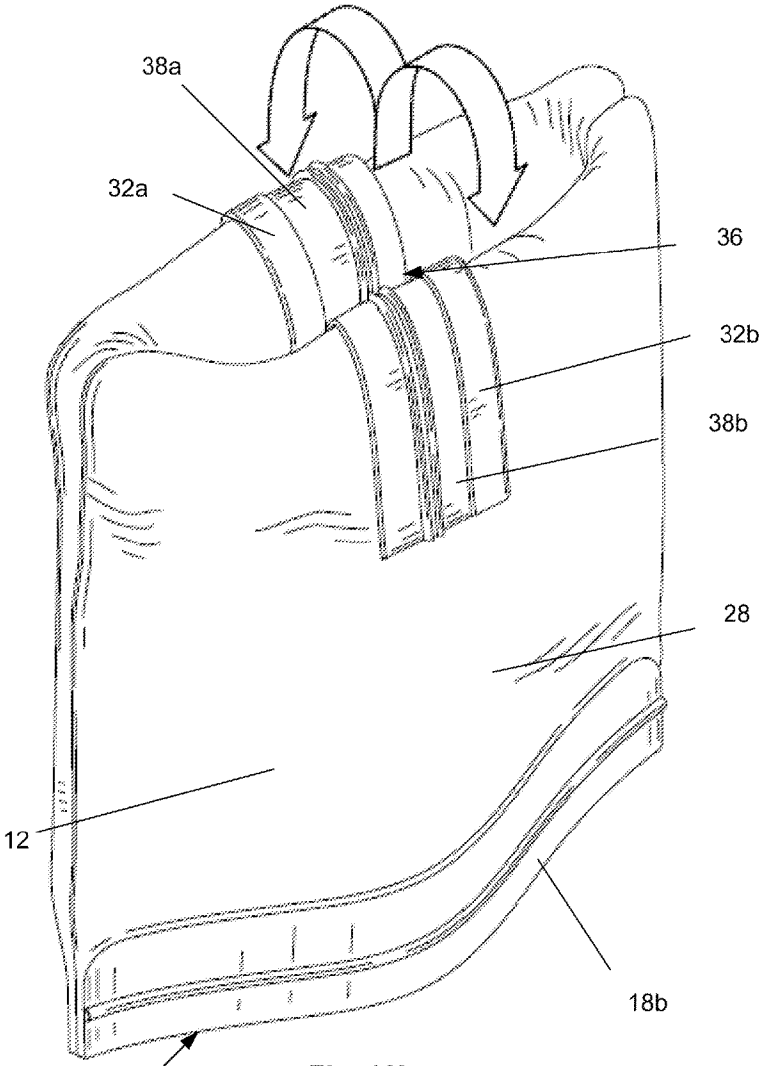
Figure 10G:
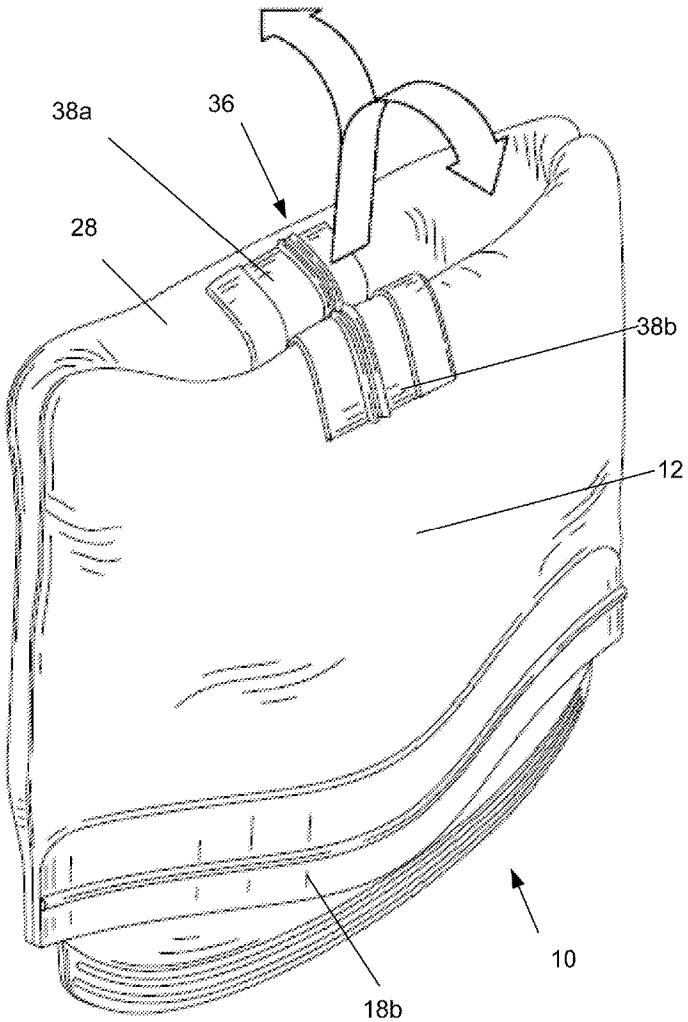

FIGS. 10*g* and 10*h* illustrate that the zipper 36 can be further separated by further inverting the bag 12 and/or by further manually pulling the zipper first wall 38*a* away from the zipper second wall 38*b*, as shown by arrows. The zipper 36 can be progressively separated along the length of the zipper 36. If the reservoir system 10 has another sequential attachment configuration, such as the buttons 64 and slots 62 disclosed herein, the attachment configuration can be attached or detached in a sequential procession along the length of the attachment configuration, such as the zipper 36.

Figure 10J:
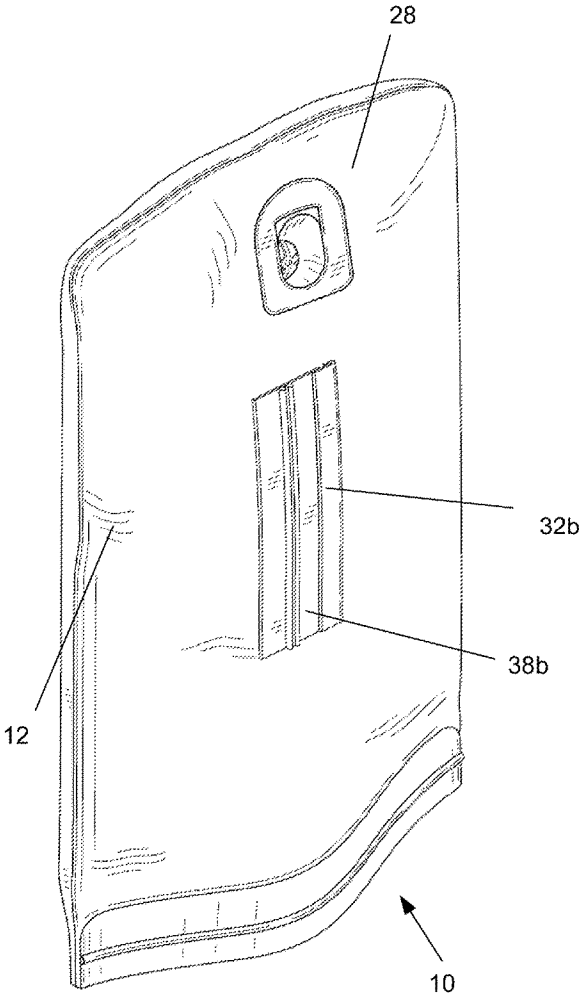
Figure 10I:
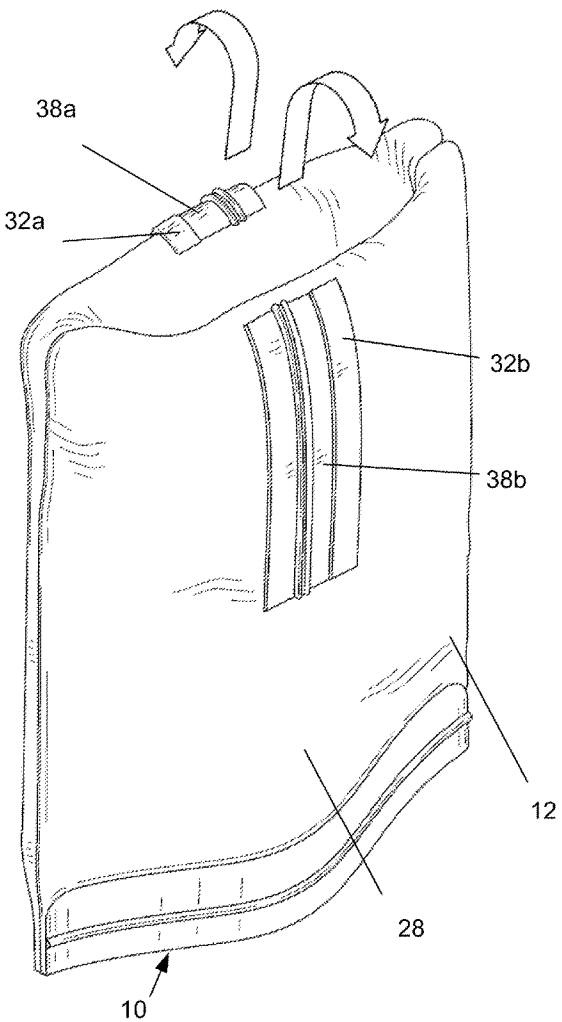

FIG. 10*i* illustrates that the bag 12 can be further inverted after complete separation of the zipper 36. FIG. 10*j* illustrates that the bag 12 can be completely inverted, exposing the entire interior surface of the bag exterior wall 28 to the outside of the reservoir system 10. The bag exterior wall 28 can be washed or otherwise cleaned, dried, repaired, or combinations thereof, while in a completely inverted configuration.

Figure 10L:
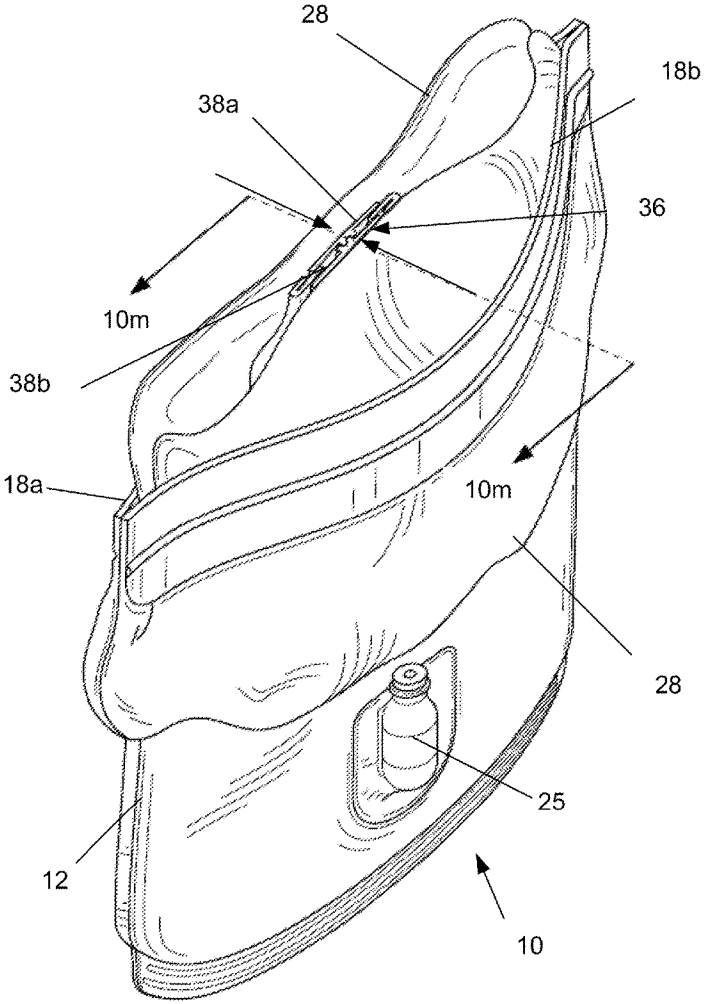
Figure 10K:
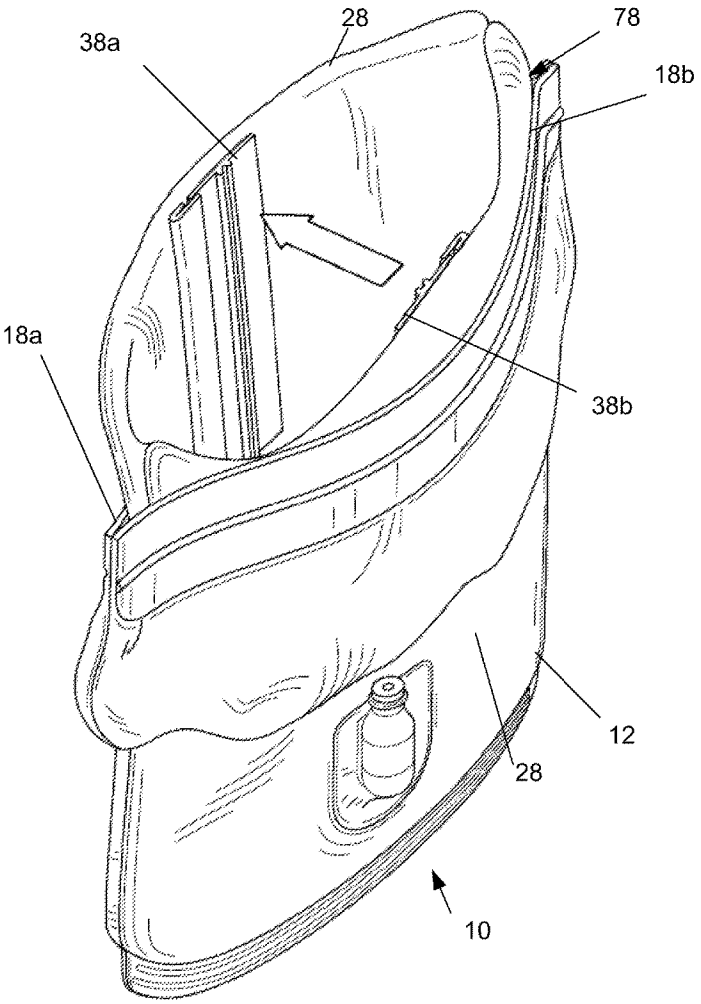

FIG. 10*k* illustrates that to reconstruct the bag 12, the bag 12 can be partially everted (i.e., returned to a partially-inverted configuration). The zipper first wall 38*a* can be aligned with the zipper second wall 38*b* to place the two halves of the zipper 36, on the zipper first wall 38*a* and the zipper second wall 38*b*6, in contact. The zipper 36 can then be pressed together to close the zipper 36, for example using manual pressure applied with the user's fingers, as shown by arrow.

Figure 10M:
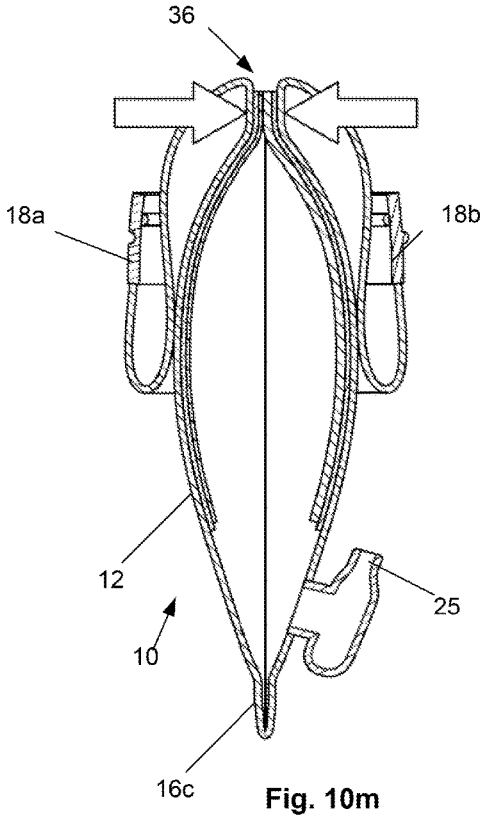

FIGS. 10*l* and 10*m* illustrate that the closing pressure on the zipper 36 can be applied, as shown by arrows, from one or both sides at the top of the length of the zipper 36, for example, to progressively seal the zipper 36 along the length of the zipper 36 while further everting the bag 12. The zipper 36 can be further squeezed, for example to check and secure the attachment of the zipper 36, while the bag 12 remains in a partially inverted configuration or is fully reconfigured to a non-inverted (i.e., fully everted) outside-out configuration.

Figure 10N:
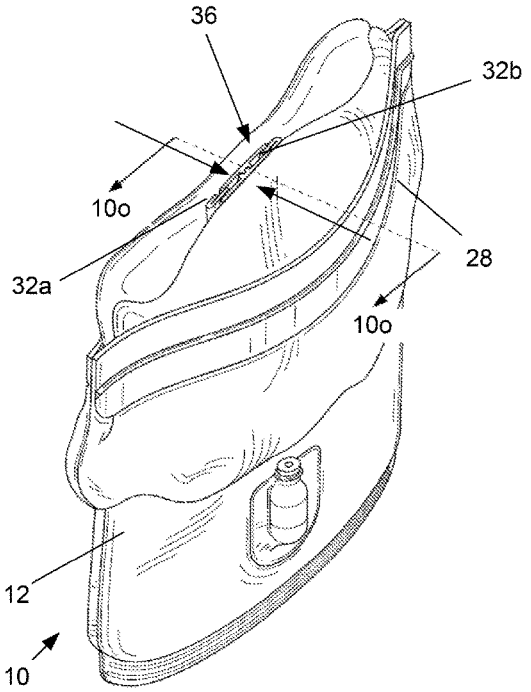
Figure 10O:
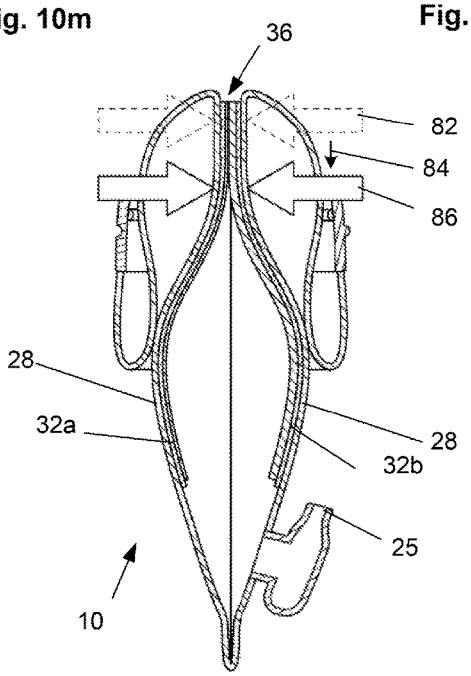

FIGS. 10*n* and 10*o* illustrate that the pressure to close the zipper 36 can be progressively slid down the length of the zipper 36. For example, the zipper closing pressure can initially be at a first terminal end of the zipper 36, as shown by arrows 82, and then be slid down, as shown by arrow 84, to a second terminal end of the zipper 36.

Figure 10P:
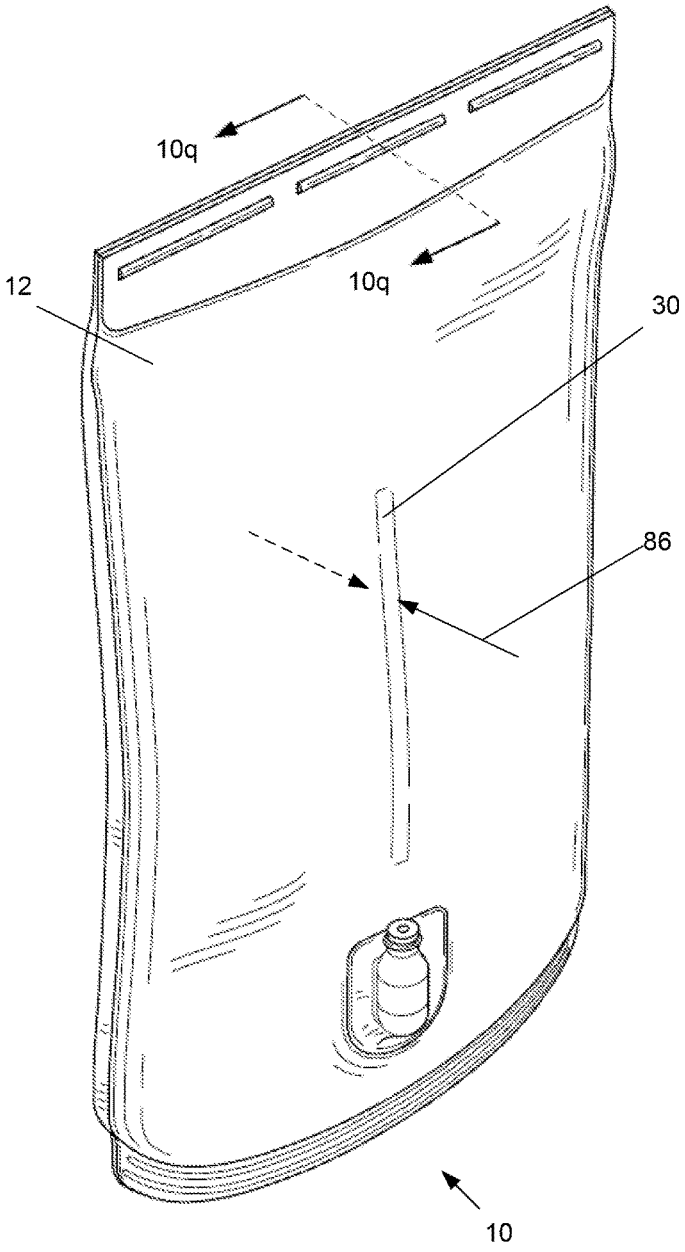
Figure 10Q:
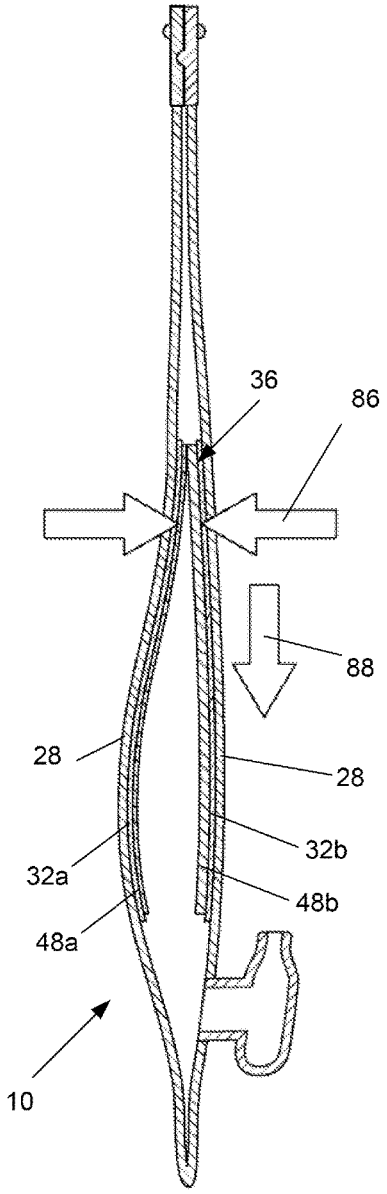

FIGS. 10*p* and 10 *q* illustrate that when the bag 12 is fully everted back to an outside-out configuration, manual pressure can be applied through the bag 12 along the length of the zipper 36, for example to insure a secure connection of the zipper 36. The closing compressive pressure can be applied at a first length along the zipper 36, as shown by arrows 86, and then slid further down the zipper 36, as shown by arrow 88.

Figure 10R:
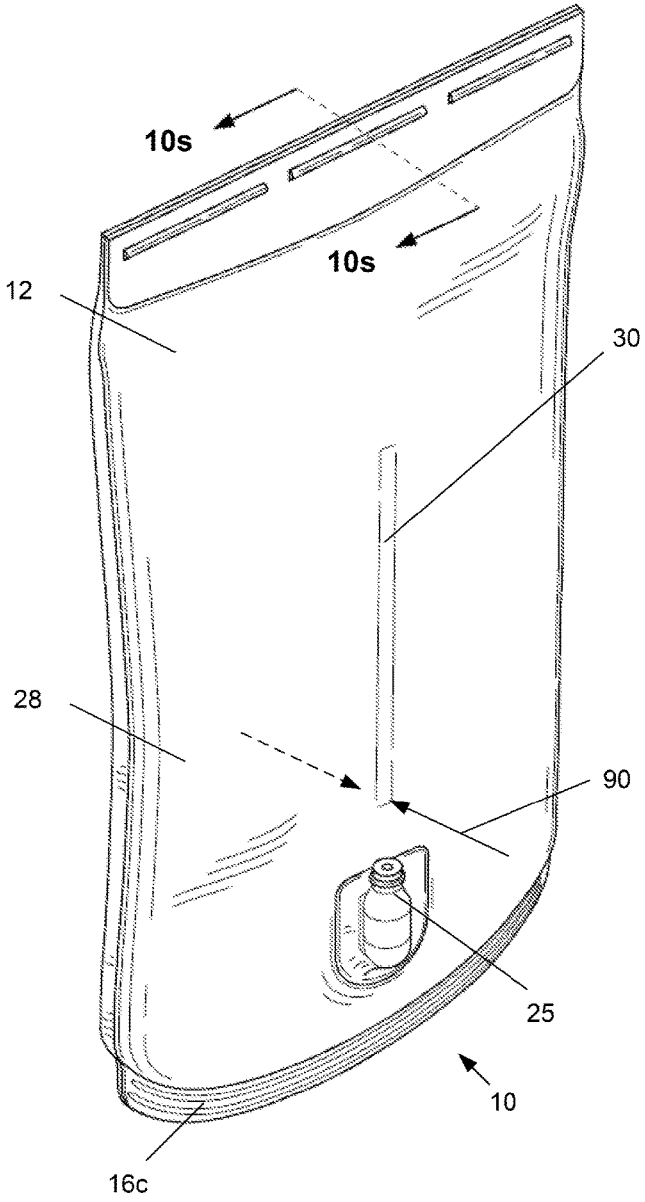
Figure 10S:
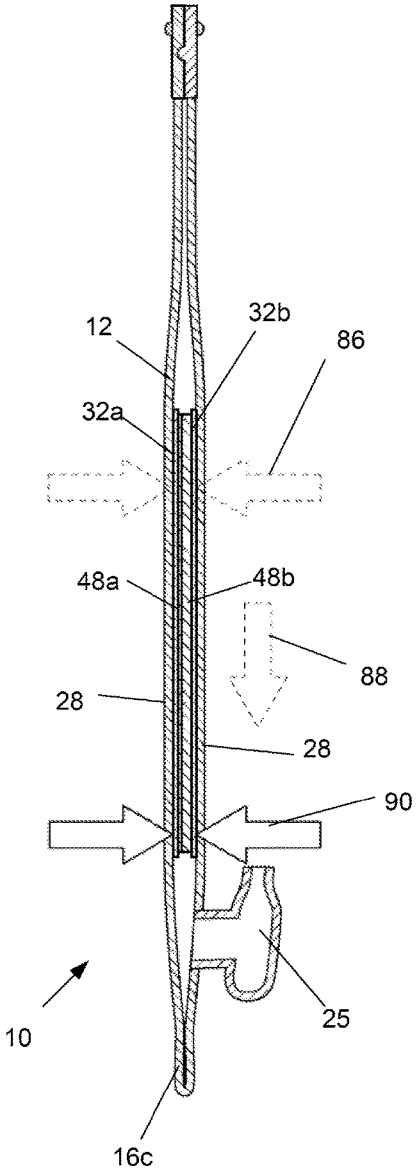

FIGS. 10*r* and 10*s* illustrate that the entire length of the entire length of the zipper 36 can be closed by sliding the closing pressure down, as shown by arrow 88, to the bottom-terminal end of the zipper 36, as shown by arrows 90. The zipper 36 can be closed and secured (i.e., fixed) along the entire length of the zipper 36. The bag 12 is shown in a collapsed stated in FIGS. 10*p*-10*s*, but the brace exterior connectors 30 can rotate with respect to the bag exterior walls 28, for example as the reservoir 15 is filled with a fluid.

The zipper 36 can, but does not have to, be reattached before liquid is delivered into the reservoir 15. After the reservoir 15 is desirably refilled, the slider 14 can be reattached, sealing the orifice 78. The zipper 36 can be substituted with or used in additional to any of the other attachment configurations shown herein, such as the fork 40, brace slider 50, buckles 50, buttons 64 and slots 62, or combinations thereof. For example, the insertion of the buttons 64 into the respective slots 62 can be concurrent with each other or can be sequential (e.g., as shown for the zipper in FIGS. 10*k* through 10*s*, for example from the top end of the brace 20 to the bottom end of the brace 20 while the bag 12 is reverted to an outside-out configuration (i.e., while be everted).

When pressure in the bag 12 increases (e.g., when the bag 12 contains fluid and the bag 12 is squeezed), the brace 20 can apply tension between the front and back walls of the bag 12 to maintain the constant maximum depth of the bag 12. The slider 14 can apply compression on the orifice 78, for example, sealing the reservoir 15.

When loaded in a backpack, the bag 12 can maintain a maximum depth and shape when internal liquid pressure or external pressure is applied to the bag 12. The backpack can, in turn, not be subjected to deforming forces from the reservoir system 10.

It is apparent to one skilled in the art that various changes and modifications can be made to this disclosure, and equivalents employed, without departing from the spirit and scope of the invention. Elements of systems, devices and methods shown with any embodiment are exemplary for the specific embodiment and can be used in combination or otherwise on other embodiments within this disclosure.

We claim:

1. A liquid reservoir system comprising:

a reservoir container comprising an orifice, a first reservoir wall, and a second reservoir wall opposite the first reservoir wall, wherein the first reservoir wall is coupled to the second reservoir wall along a first lateral edge, a second lateral edge, and a reservoir bottom edge of the reservoir container, wherein the first reservoir wall has a first interior wall side and a first exterior wall side, wherein the second reservoir wall has a second interior wall side and a second exterior wall side, wherein the first reservoir wall and the second reservoir wall define a reservoir cavity configured to hold a liquid; and a brace comprising a first brace wall, a first zipper wall, a second brace wall, and a second zipper wall located within the reservoir cavity, wherein the first brace wall is coupled to the first zipper wall along one lateral edge of the first brace wall and the first brace wall is coupled to the first interior wall side along another lateral edge of the first brace wall, and wherein the first brace wall has a first fold extending along a length of the first brace wall positioned in between the first zipper wall and the first interior wall side, wherein the second brace wall is coupled to the second zipper wall along one lateral edge of the second brace wall and second brace wall is coupled to the second interior wall side along another lateral edge of the second brace wall, and wherein the second brace wall has a second fold extending along a length of the second brace wall positioned in between the second zipper wall and the second interior wall side, wherein the reservoir container has a zipped configuration, wherein the first zipper wall is detachably fastened to the second zipper wall when the reservoir container is in the zipped configuration; and wherein the reservoir cavity is configured to receive the liquid when the reservoir container is in the zipped configuration.

2. The system of claim 1, wherein a portion of the first reservoir wall is laterally translatable relative to a portion of the second reservoir wall when the reservoir container is in the zipped configuration.

3. The system of claim 2, wherein the portion of the first reservoir wall coupled to the first brace wall is laterally translatable relative to the portion of the second reservoir wall coupled to the second brace wall when the reservoir containers is in the zipped configuration.

4. The system of claim 1, wherein the first brace wall is moveable relative to the first reservoir wall and the second brace portion wall is moveable relative to the second reservoir wall when the reservoir container is in the zipped configuration.

5. The system of claim 1, wherein the reservoir container is in an unzipped configuration when the first zipper wall is detached from the second zipper wall, wherein the first brace wall is configured to fold such that the first zipper wall is parallel to the first reservoir wall and the second brace wall is configured to fold such that the second zipper wall is parallel to the second reservoir wall when the reservoir container is in the unzipped configuration.

6. The system of claim 1, wherein the reservoir container is invertible such that a part of the first interior wall side and a part of the second interior wall side is exposed.

7. The system of claim 1, further comprising an outlet socket coupled to the first reservoir wall or the second reservoir wall, wherein the outlet socket is positioned in between the brace and the reservoir bottom.

8. The system of claim 1, further comprising a reservoir slider configured to close and seal the orifice and couple a first orifice edge of the first reservoir wall to a second orifice edge of the second reservoir wall.

9. The system of claim 8, further comprising one or more guides along the first exterior wall side and the second exterior wall side and wherein the reservoir slider is configured to slide over the one or more guides.

10. The system of claim 8, wherein the orifice is defined by the first orifice edge and the second orifice edge, wherein the first orifice edge and the second orifice edge extend from the first lateral edge to the second lateral edge, and wherein at least one of the first orifice edge and the second orifice edge is curved when the orifice is open.

11. The system of claim 1, wherein the brace comprises a polyurethane.

12. The system of claim 11, wherein the polyurethane comprises TPU.

13. The system of claim 1, wherein the brace does not extend the entire length of the reservoir cavity.

14. The system of claim 1, wherein the first zipper wall is parallel to the second zipper wall when the reservoir container is in the zipped configuration.

15. The system of claim 1, wherein the brace has a first terminal end and a second terminal end and the first terminal end is opposite the second terminal end, wherein the first terminal end is separated from the orifice by a first longitudinal length and wherein the second terminal end is separated from a bottom edge of the reservoir container by a second longitudinal length.

16. A method of using a reservoir system, comprising:

separating a brace within a reservoir container of the reservoir system, by pulling a first zipper wall of the brace away from a second zipper wall of the brace;

wherein the reservoir container comprises an orifice, a first reservoir wall coupled to a second reservoir wall along a first lateral edge, a second lateral edge, and a reservoir bottom edge of the reservoir container, wherein the reservoir container is configured to receive a liquid through the orifice when the reservoir container is in a zipped configuration, wherein the first reservoir wall has a first interior wall side and a first exterior wall side and wherein the second reservoir wall has a second interior wall side and a second exterior wall side, wherein the brace further comprises a first brace wall coupled to the first zipper wall along one lateral edge of the first brace wall and wherein the first brace wall is coupled to the first interior wall side along another lateral edge of the first brace wall, and wherein the first brace wall has a first fold extending along a length of the first brace wall positioned in between the first zipper wall and the first interior wall side, wherein the brace further comprises a second brace wall coupled to the second zipper wall along one lateral edge of the second brace wall and wherein the second brace wall is coupled to the second interior wall side along another lateral edge the second brace wall, and wherein the second brace wall has a second fold extending along a length of the second brace wall positioned in between the first zipper wall and the second interior wall side;

inverting the reservoir container by pulling a first orifice edge of the first reservoir wall outward and around the first exterior wall side such that the first interior wall side is exposed and pulling a second orifice edge of the second reservoir wall outward and around the second exterior wall side such that the second interior wall side is exposed; and cleaning at least one of a portion of the first interior wall side and a portion of the second interior wall side.

17. The method of claim 16, further comprising fastening the brace by pressing the first zipper wall into the second zipper wall.

18. The method of claim 17, further comprising:

filling a reservoir cavity within the reservoir container with a liquid through the orifice; and sealing the orifice by sliding a reservoir slider of the reservoir system over the first orifice edge and the second orifice edge.

19. A method of using a reservoir system, comprising:

fastening a brace within a reservoir container of the reservoir system, by pressing a first zipper wall of the brace against a second zipper wall of the brace, wherein the reservoir container comprises a first reservoir wall coupled to a second reservoir wall along a first lateral edge, a second lateral edge, and a reservoir bottom edge of the reservoir container, wherein the first reservoir wall has a first interior wall side and a first exterior wall side and wherein the second reservoir wall has a second interior wall side and a second exterior wall side, wherein the brace further comprises a first brace wall coupled to the first zipper wall along one lateral edge of the first brace wall and wherein the first brace wall is coupled to the first interior wall side along another lateral edge of the first brace wall, and wherein the first brace wall has a first fold extending along a length of the first brace wall positioned in between the first zipper wall and the first interior wall side, wherein the brace further comprises a second brace wall coupled to the second zipper wall along one lateral edge of the second brace wall and wherein the second brace wall is coupled to the second interior wall side along another lateral edge the second brace wall, and wherein the second brace wall has a second fold extending along a length of the second brace wall positioned in between the first zipper wall and the second interior wall side;

filling a reservoir cavity within the reservoir container with a liquid through an orifice of the reservoir container when the reservoir container is in a zipped configuration, wherein the orifice is defined by a first orifice edge of the first reservoir wall and a second orifice edge of the second reservoir wall; and sealing the orifice by sliding a reservoir slider of the reservoir system over the first orifice edge and the second orifice edge.

20. The method of claim 19, further comprising detaching the first zipper wall from the second zipper wall by pulling the first zipper wall away from the second zipper wall.

* * * * *